US005220737A

United States Patent [19]

Edington

[11] Patent Number: 5,220,737

[45] Date of Patent: Jun. 22, 1993

[54] SHOE SOLE HAVING IMPROVED LATERAL AND MEDIAL STABILITY

[75] Inventor: Christopher J. Edington, Derry, N.H.

[73] Assignee: Converse Inc., North Reading, Mass.

[21] Appl. No.: 767,108

[22] Filed: Sep. 27, 1991

[51] Int. Cl.[5] ..... A43B 13/18; A43B 21/26

[52] U.S. Cl. ..... 36/28; 36/29; 36/35 B; 36/114

[58] Field of Search ..... 36/28, 29, 35 R, 35 B, 36/68, 69, 71, 88, 93, 107, 108, 114, 153

[56] References Cited

U.S. PATENT DOCUMENTS

| | | | |
|---|---|---|---|
| 4,219,945 | 9/1980 | Rudy | 36/29 |
| 4,402,146 | 9/1983 | Parracho et al. | 36/69 |
| 4,484,397 | 11/1984 | Curley, Jr. | 36/68 |
| 4,486,964 | 12/1984 | Rudy | 36/28 |
| 4,490,928 | 1/1985 | Kawashima | 36/69 |
| 4,506,460 | 3/1985 | Rudy | 36/28 |
| 4,598,487 | 7/1986 | Misevich | 36/114 |
| 4,766,679 | 8/1988 | Bender | 36/68 |
| 4,817,304 | 4/1989 | Parker et al. | 36/28 |
| 4,843,741 | 7/1989 | Yung-Mao | 36/28 |
| 4,845,863 | 7/1989 | Yung-Mao | 36/28 |
| 4,878,301 | 11/1989 | Kiyosawa | 36/69 |
| 4,914,836 | 4/1990 | Horovitz | 36/28 |
| 4,970,807 | 11/1990 | Anderié et al. | 36/35 R |
| 5,005,300 | 4/1991 | Diaz et al. | 36/28 |
| 5,025,573 | 6/1991 | Giese et al. | 36/31 |
| 5,046,267 | 9/1991 | Kilgore et al. | 36/114 |
| 5,092,060 | 3/1992 | Frachey et al. | 36/28 |

*Primary Examiner*—Steven N. Meyers
*Assistant Examiner*—M. D. Patterson
*Attorney, Agent, or Firm*—Rogers, Howell & Haferkamp

[57] ABSTRACT

A shoe sole having improved lateral and medial stability is comprised of a shoe sole formed from a material having a predetermined hardness and one or more stabilizer apparatus contained in the shoe sole, the stabilizer apparatus being formed from a material having a hardness different or the same as the hardness of the shoe sole. The stabilizer apparatus are formed with opposed support wall sections that are positioned adjacent the sidewalls of the shoe sole and resist the compression of the midsole in the areas adjacent the opposite left and right sidewalls. The spacing of the stabilizer support walls at the opposite left and right sides of the midsole prevents the support walls from appreciably affecting the cushioning ability of the portion of the midsole between the stabilizer sidewalls. In variant embodiments of the invention, the medial portions of the midsole between the stabilizer left and right support wall sections is occupied by a fluid filled pad provided as a cushion in the midsole, or is occupied by the material of the midsole having a different or the same hardness value than the support walls of the stabilizer. In a still further variant, ports are provided in the sidewalls of the midsole corresponding to the positions of the stabilizers, and the support wall sections of the stabilizers are transparent to enable viewing of a fluid pad positioned between the opposed support wall sections from outside the sidewalls of the midsole.

21 Claims, 2 Drawing Sheets

FIG. 1.
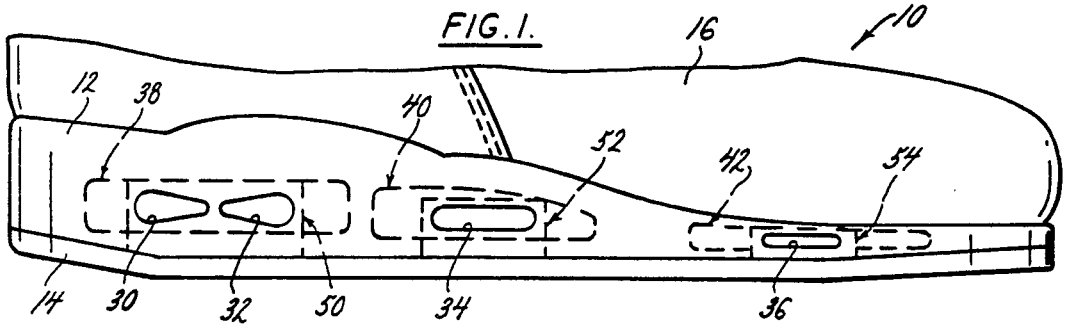
FIG. 2.
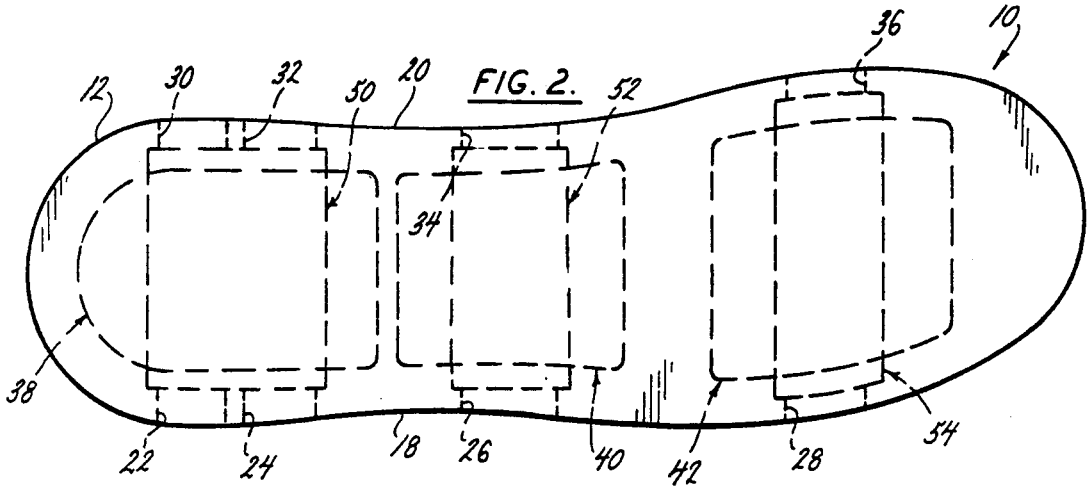
FIG. 3.
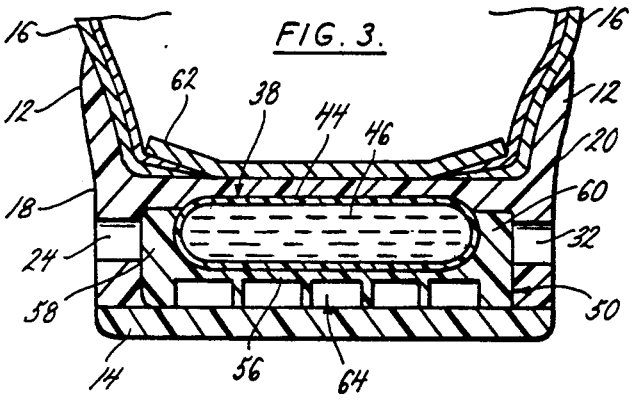
FIG. 6.
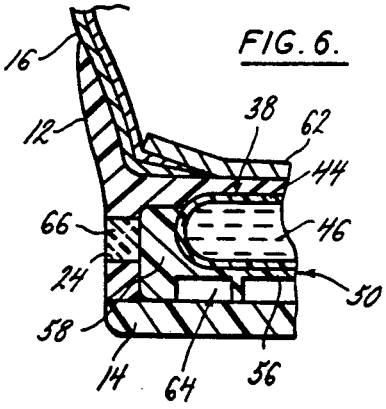
FIG. 4.
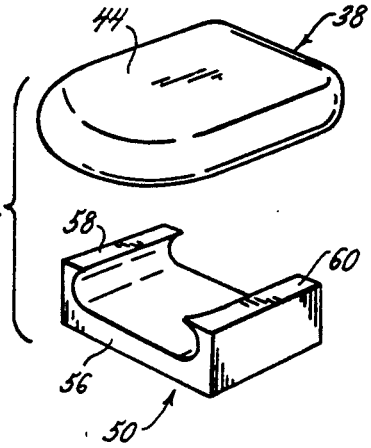
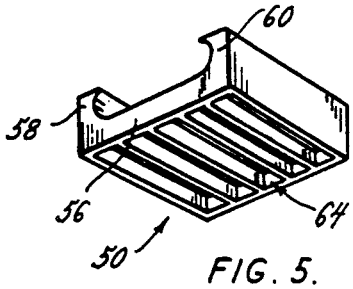
FIG. 5.

SHOE SOLE HAVING IMPROVED LATERAL AND MEDIAL STABILITY

BACKGROUND OF THE INVENTION (1) Field of the Invention

The present invention relates to a shoe sole having improved lateral and medial stability. In particular, the present invention pertains to a shoe sole having a stabilizing apparatus either inserted into the sole or formed in the sole, where the stabilizing apparatus alters the ability of the shoe sole to resist compression at opposite left and right sides of the sole where the apparatus is inserted, thereby improving the lateral and medial stability of the shoe. The stabilizing apparatus of the present invention is particularly useful in shoe soles employing fluid filled bladders or pads as cushions.

(2) Description of the Related Art

Many types of shoe soles are required to have a certain amount of cushioning to absorb shocks from footstep impact and thereby protect the foot from these shocks. This is particularly true in athletic footwear where the foot is exposed to repeated shocks from footstep impact in running and other athletic activities.

Prior art shoes have been developed employing a variety of different cushioning devices between the foot and the outsole of the shoe to protect the foot from the shock of footstep impact. These prior art cushioning devices range from merely constructing the shoe sole from a softer, more resilient material to incorporating fluid filled pads or bladders in the sole of a shoe.

In many shoe soles designed to increase the cushioning effects of the shoe sole, the increased resiliency or "softness" of the shoe sole provides no resistance to the tendency of a shoe wearer's foot to rotate relative to the leg upon impact. The tendency for excessive lowering of the medial margin of the foot, or excessive pronation, and the tendency for excessive raising of the medial margin of the foot, or supination, have the potential of causing injuries to the wearer of the shoe.

Concepts have been developed to increase the lateral and medial stability of the shoe. One such concept is disclosed in U.S. Pat. No. 4,402,146, assigned to the assignee of the present invention. The aforesaid patent discloses a shoe having increased lateral stability comprising a pair of tabs extending from opposite sides of the outsole of the shoe to the heel counter of the shoe, thereby resiliently connecting the outsole to the heel counter and increasing the lateral medial stability of the shoe. The tabs are formed as an integral part of the shoe outsole and are bonded to a heel wedge layer and midsole layer of the shoe sole as well as the heel counter.

The shoe sole stabilizer described above is disadvantaged in that it is adhered over the outside of the shoe sole and heel counter and is visible. This requires that the tabs be designed in such a way to make them a part of the overall design appearance of the shoe. Furthermore, the tabs being adhered to the extreme outer sides of the heel wedge and midsole reduce the ability of the tabs to resist compression of the heel wedge and midsole in the areas of the wedge and midsole inside the shoe surrounding the wearer's foot.

The present invention overcomes disadvantages associated with prior art shoe sole lateral and medial stabilizers by providing a lateral and medial stabilizer for a shoe sole that is contained inside a sole layer or member of the shoe sole. The stabilizer of the invention serves to increase or decrease the resistance to compression of the shoe sole member at positions adjacent to the opposite left and right sidewalls of the sole member, without significantly effecting the cushioning ability of a middle portion of the sole member between its left and right sidewalls. In variant embodiments of the invention the stabilizer is employed to increase or decrease the resistance to compression of the opposite left and right sidewalls of the shoe sole member. Furthermore, the stabilizing apparatus of the present invention is ideally suited for use in shoe soles incorporating fluid filled pads or bladders, thereby combining the desirable cushioning ability of the fluid filled pad with the improved lateral and medial stability provided by the apparatus of the present invention.

SUMMARY OF THE INVENTION

The present invention provides a shoe sole having increased lateral and medial stability without effecting the ability of the shoe sole to cushion the shock of footstep impact. In the preferred embodiment of the invention, the sole member is a shoe midsole having a forefoot section, an arch section, and a heel section. The midsole has opposite left and right sidewalls extending around opposite sides of the midsole from the forefoot section and over the arch and heel sections. The midsole is formed from a resilient material having a predetermined measure of hardness.

The first embodiment of the stabilizer of the invention has a general U-shaped configuration with a bottom base member and left and right support wall sections extending substantially parallel to each other at opposite ends of the base member. The base member and support wall sections are formed integrally from a resilient material having a predetermined hardness greater than the hardness of the midsole. In additional embodiments of the invention the base member and support walls are formed of a material having a hardness different or the same as the hardness of the midsole.

The stabilizer member is contained in the midsole at the heel section of the midsole, and may also be inserted in the midsole at the arch and forefoot sections or a combination of all three. The width of the stabilizer base member and its orientation in the midsole heel section positions the left and right support walls of the stabilizer adjacent the opposite left and right sidewalls of the midsole. In variant embodiments of the invention, apertures are provided in the opposite sides of the midsole to enable viewing the left and right support walls of the stabilizer from outside the midsole.

By positioning the stabilizer inside the midsole as described above, the increased rigidity of the opposite left and right support walls of the stabilizer over the rigidity of the midsole increases or decreases the midsole's resistance to compression along the opposite left and right sides of the midsole where the stabilizer support walls are positioned. The increased or decreased rigidity of the midsole in the areas of the stabilizer support walls increases the lateral and medial stability of the midsole. Because the support walls of the stabilizer are positioned adjacent the opposite left and right sidewalls of the midsole, their increased or decreased rigidity or hardness does not significantly affect or detract from the cushioning of the midsole between the support walls.

The shoe sole with the stabilizer apparatus of the present invention is ideally suited for use with fluid filled pads as cushioning devices. In the above-described structure of the shoe sole incorporating the stabilizer apparatus of the invention, the fluid filled pad would be positioned in the midsole between the left and right support walls of the stabilizer apparatus. In this position of the fluid pad, the support walls increase the lateral and medial stability of the shoe sole in the manner described above, and the fluid filled pad provides a cushion in the shoe sole intermediate the stabilizer support walls, the cushioning ability of which is not significantly affected by the presence of the stabilizer. Where prior art shoe soles incorporating fluid filled pads as cushions are often lacking in lateral and medial stability, the stabilizing apparatus of the present invention provides increased lateral and medial stability to shoe soles with fluid filled pads without significantly detracting from the cushioning ability of the pads.

In a further embodiment, the stabilizer of the invention has a general U-shaped configuration that is contained in the midsole of the shoe in an upside down orientation. This embodiment of the stabilizer functions in substantially the same manner as the first embodiment of the stabilizer described above. This embodiment of the stabilizer may also be used with fluid pads contained in the midsole, with the base member of the stabilizer extending over the top of the fluid pad and the left and right support walls of the stabilizer depending downward from the base member on opposite left and right sides of the fluid pad.

In a still further embodiment of the stabilizer of the invention, the stabilizer is provided with vertically spaced top and bottom base members. The base members extend between the left and right support walls of the stabilizer in much the same manner as the previously described embodiments, and the fluid pad is retained between the left and right support walls with the top base member extending over the top of the pad and the bottom base member extending beneath the bottom of the pad.

In still further embodiments of the stabilizer apparatus of the invention, the stabilizer embodiments described above are constructed of a resilient material having a hardness different or the same as that of the midsole. These embodiments of the invention are employed in shoe soles where it is desirable to have the opposite left and right sides of the shoe midsole having different or the same resistance to compression than a middle portion of the midsole.

BRIEF DESCRIPTION OF THE DRAWINGS

Further objects and features of the present invention are revealed in the following Detailed Description of the Preferred Embodiment of the invention and in the drawing figures wherein:

FIG. 1 shows a partial side elevation view of a shoe constructed with the shoe sole of the present invention;

FIG. 2 is a plan view of the bottom of the shoe sole of the present invention;

FIG. 3 is a partial elevation view, in section, of the shoe sole of the present invention;

FIG. 4 is an exploded view of the stabilizer apparatus of the present invention and a fluid filled pad;

FIG. 5 is perspective view of the stabilizer apparatus of the present invention;

FIG. 6 is a partial elevation view, in section, of the shoe sole of the present invention;

DESCRIPTION OF THE PREFERRED EMBODIMENT

Figure 7:
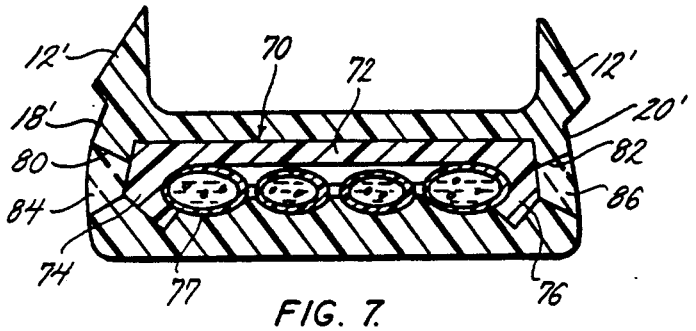
FIG. 7 is a partial elevation view, in section, of a further embodiment of the shoe sole of the present invention.

FIG. 1 shows a shoe 10 in which the shoe sole 12 of the present invention has been incorporated as a midsole. Although the shoe sole 12 of the present invention is shown as a midsole in FIG. 1, it should be understood that the subject matter of the present invention defined in the claims may be incorporated into other component parts of a shoe sole such as a shoe outsole, upper sole or a heel lift area of a sole without departing from the intended scope of the claims.

As seen in FIG. 1, an outsole 14 is adhered to the bottom of the midsole 12 and a shoe upper 16 is secured to the top of the midsole. At several positions along the left side 18 of the midsole 12 and along the right side 20 of the midsole are ports 22, 24, 26, 28, 30, 32, 34, 36. The ports 22–36 extend into the midsole 12 from the outside left and right sides 18, 20 of the midsole. The purpose for the ports is explained later in the specification.

In the embodiment of the invention shown in the drawing figures, the midsole 12 is formed of an expanded plastic foam. The midsole 12 is formed with one or more fluid filled bladders or pads 38, 40, 42 contained inside the midsole as seen in the detail of FIGS. 3 and 6. The fluid pad 38 comprises a flexible envelope 44 constructed of a plastic material, and a fluid 46 filling the interior volume of the envelope as is conventional in fluid pads employed in shoe soles. The fluid pads 38–42 may be positioned in the midsole as the midsole is molded, or the midsole may be molded with cavities provided for the later insertion of the fluid pads into the midsole.

Also contained in the midsole 12 are three variants of the stabilizer apparatus 50, 52, 54 of the present invention. Like the fluid filled pads, 38–42, the stabilizer apparatus 50–54 may be positioned in the midsole sole 20 as the midsole is molded or may inserted into cavities provided in the midsole as it is molded to accommodate the three different stabilizers.

The details of the stabilizer 50 positioned in the heel of the midsole 12 are shown in FIGS. 4 and 5. The component parts of the stabilizers 50–54 are substantially identical in each stabilizer except for differences in length and width dimensions, and only the stabilizer apparatus 50 employed in the heel section of the midsole 12 will be described in detail.

The stabilizer is formed with a base member 56 and left and right upstanding support wall sections 58, 60 at opposite ends of the stabilizer base member 56. The base member 56 positions the left and right support walls 58, 60 a spaced distance apart from each other to position the support walls adjacent the left and right sidewalls 18, 20 of the midsole, and to position the left and right support walls 58, 60 at locations beneath the interior of the shoe just below the outer edges of the upper sole or sock liner 62. This positioning of the left and right support walls 58, 60 by the base member 56 also positions the support walls below the left and right sides of a foot inserted into the shoe. The stabilizer 50 is formed with a plurality of cavities 64 provided in the underside of the base member 56. The cavities 64 reduce the over-all weight of the stabilizer without significantly affecting the strength of the base member.

The left and right support walls 58, 60 extend substantially parallel to each other over the top surface of the base member 56 at opposite ends of the base member. The mutually confronting sides of the support walls in the embodiment of the stabilizer shown in FIGS. 4 and 5 have a configuration that is complementary to the configuration of the sides of the fluid pad 38 contained in the midsole heel section. The confronting surfaces of the support walls 58, 60 may be altered to complement fluid pads employed with the shoe sole of the invention having different configurations than that shown in the drawing figures. Alternatively, the mutually confronting surfaces of the support walls 58, 60 may be flat, parallel surfaces and are not required to conform to the shape of a fluid pad employed with the shoe sole. The base member 56 and left and right support walls 58, 60 of the stabilizer 50 are formed integrally from a resilient material having a different hardness than the midsole.

The stabilizer apparatus 50 of the present invention is shown in FIGS. 3 and 6 contained in the heel section of the midsole 12 of the present invention. As shown in the drawing figures, the stabilizer 50 may be positioned inside the midsole 12 as the midsole is molded, or may later be inserted into a cavity molded into the midsole heel section that is specifically configured to receive the stabilizer. As seen in the drawing figures, the left and right support walls 58, 60 of the stabilizer are positioned adjacent the left and right sidewalls 18, 20 respectively, of the midsole. The bottom of the stabilizer 50 may be flush with the bottom of the midsole 12 so that the outsole 14 may be adhered over both the stabilizer and midsole without any modification of their bottom surfaces.

The stabilizers 50–54 retain the fluid filled pad(s) 38–42 between the support walls of the stabilizers. As seen in FIG. 2, the fluid pads 38–42 may extend slightly beyond their respective stabilizers 50–54 in any direction of the midsole 12, but are laterally retained between the opposed support wall sections of each of the stabilizers.

The ports 22–36 formed in the opposite sidewalls of the midsole 12 extend through the midsole a sufficient distance to expose the opposite left and right support walls 58, 60 of the stabilizer to the exterior of the midsole. As seen in FIGS. 1 and 2, each of the ports 22–36 enables the viewing of the opposite support walls of each of the stabilizers 50–54 from outside the opposite sidewalls of the midsole.

In the preferred embodiment of the invention, the resilient material employed in constructing each of the stabilizers 50–54 is a transparent plastic material. This enables the fluid pads 38–42 retained between the opposed support walls of each of the stabilizers to be viewed through the ports 32–36 of the shoe midsole and the opposed support walls of the stabilizer. This is illustrated in FIG. 3 where sighting through the opposite ports 24, 32 provided in the opposite left and right sides 18, 20 of the midsole 12, the fluid pad 38 is visible through the transparent support walls 58, 60 of the stabilizer. With the fluid pad envelope 44 being constructed of a transparent material also, the fluid 46 contained in the pad is also visible between the opposite ports 24, 32 of the midsole and the opposed support walls 58, 60 of the stabilizer. In a variant of this embodiment shown in FIG. 6, a clear plastic insert 66 is inserted into the port opening provided in the sidewall of the midsole. The insert 66 also enables viewing of the fluid filled pad 38 contained in the midsole through the support walls of the stabilizer 50, and prevents any foreign objects from being lodged in the port opening 24.

From the position of the stabilizer 50 relative to the midsole sidewalls 20, 18 and the position of the fluid pad 38 as seen in FIG. 3, it can be seen that the left and right support wall sections 58, 60 of the stabilizer, having a different or the same rigidity or hardness over that of the adjacent left and right sides of the midsole 12, will serve to increase the resistance to compression of the left and right sides of the midsole adjacent the support walls. It can also be seen in FIG. 3 that the left and right support wall sections 58, 60 of the stabilizer, while increasing the resistance to compression of the opposite left and right sides of the midsole, do not appreciably affect the ability of the fluid filled pad 38 to cushion the heel area of the foot from shocks due to impact. In this manner, the shoe sole 12 incorporating the stabilizer 50 of the present invention increases the lateral and medial stability of the shoe without appreciably detracting from the cushioning ability of the shoe sole.

FIG. 7 shows an additional embodiment of the stabilizer apparatus 70 of the present invention positioned in the sole 12' of a shoe similar to the midsole 12 of FIG. 1. Like the previously described embodiment, the embodiment of the stabilizer shown in FIG. 7 may be positioned in the heel, arch or forefoot sections of the shoe, or a combination of all three positions. The stabilizer is formed with a base member 72 and left and right support wall sections 74, 76 at opposite ends of the stabilizer base member. Like the previously described embodiment, the base member 72 positions the left and right support wall sections 74, 76 a spaced distance apart from each other to position the support wall sections adjacent the left and rights sidewalls 18', 20' of the shoe sole. As seen in the drawing figure, the stabilizer 70 contains a fluid filled pad 77 between its opposite left and right support wall sections 74, 76 in much the same manner as the previously described embodiment. The only significant difference between the previously described embodiment of the stabilizer 50 and the embodiment of the stabilizer 70 shown in FIG. 7 is that the base member 72 of the stabilizer extends over the top surface of the fluid pad 77 and the left and right support walls 74, 76 extend downward from the base member 72 on opposite sides of the fluid pad 77. The embodiment of the stabilizer shown in FIG. 7 functions in a substantially identical manner to that of the first described embodiment of the stabilizer.

Also shown in FIG. 7 are ports 80, 82 in the opposite left and right sides of the shoe sole 12', respectively. The ports 80, 82 extend through the opposite sides of the shoe sole to the support walls 74, 76 of the stabilizer 70. A pair of clear plastic inserts 84, 86 are inserted into the respective ports 80, 82. The inserts 84, 86 enable viewing of the fluid filled pad 77 contained in the shoe sole through the transparent support walls 74, 76 of the stabilizer.

Figure 8:
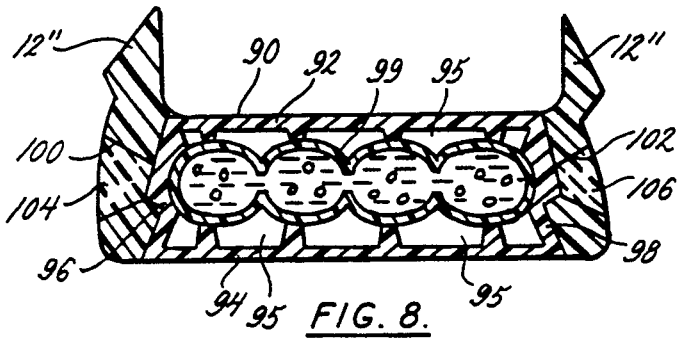
FIG. 8 is a partial elevation view, in section, of a still further embodiment of the shoe sole of the present invention.
Figure 9:
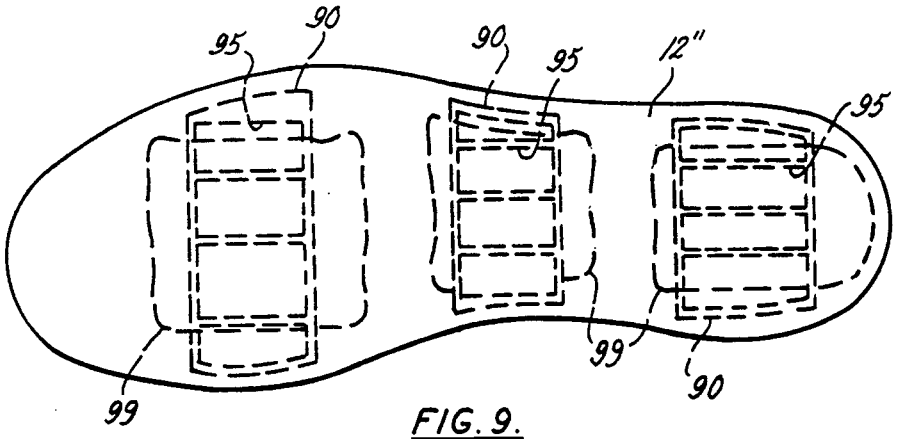
FIG. 9 is a plan view of the bottom of the shoe sole of FIG. 8.
Figure 10:
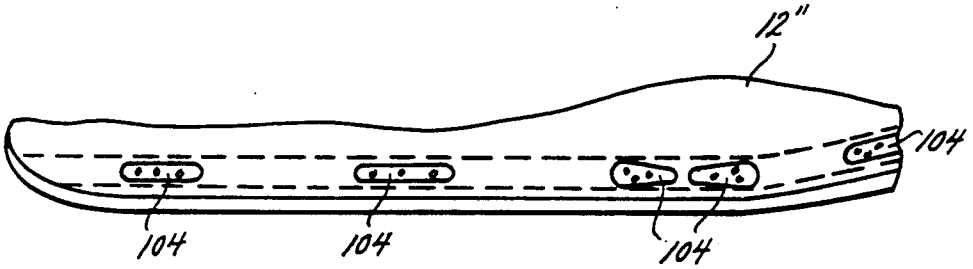
FIG. 10 is a side elevation view of the shoe sole of FIG. 8.

FIG. 8 shows a still further embodiment of the stabilizer apparatus 90 of the present invention contained in a shoe sole 12'' similar to that of FIG. 1. Like the previously described embodiments, the third embodiment of the stabilizer 90 may be contained in the heel section, arch section, or forefoot section of the shoe sole or a combination of all three as shown in FIG. 9 and 10. The third embodiment of the stabilizer 90 is formed with an upper base member 92 and a lower base member 94. Both base members are formed with hollow cavities 95 to reduce the weight of the shoe. Left and right support walls 96, 98 are connected at the opposite ends of the upper and lower base members 92, 94 and space the upper and lower base members a vertical distance apart. A fluid pad 99 is retained between the left and right support walls 96, 98 of the stabilizer 90 and is also retained between the upper and lower base members 92, 94 of this embodiment of the stabilizer. This embodiment of the stabilizer 90 is also transparent and functions in substantially the same manner as the previously described embodiments of the stabilizer. The lower base member 94 may be contained in the shoe sole flush with the bottom of the shoe to enable viewing the fluid pad 99 contained in the sole through the transparent lower base member.

Also shown in FIG. 8 are ports 100, 102 provided in the opposite left and right sides of the shoe sole 12", and a pair of clear plastic inserts 104, 106 secured in the ports. The inserts 104, 106 enable viewing of the stabilizer 90 contained in the shoe sole 12" through the transparent support walls 96, 98 of the stabilizer 90.

In each of the embodiments of the stabilizer apparatus 50, 70, 90 described above, the base member and support walls of the stabilizer may be formed of a material having a lesser hardness than the hardness of the midsole in which the stabilizers are positioned. The stabilizers of lesser hardness are employed in midsoles when it is desirable to decrease the resistance to compression of the opposite left and right sidewalls of the shoe midsole.

Although the shoe sole 12 of the present invention is described above as incorporating three stabilizers positioned at the heel, arch and forefoot of the sole, the shoe sole of the present invention may incorporate only one or two of the stabilizer apparatus shown in the drawing figures and described above. Furthermore, although the shoe sole and stabilizer apparatus is described as being employed with a shoe sole having fluid filled pads, the shoe sole of the invention may be formed with only the stabilizers, with the volumes of the midsole occupied by the fluid pads being filled with the material of the midsole. In such a shoe sole construction, the opposed left and right support walls of the stabilizer will serve to resist compression of the midsole in areas of the midsole adjacent the left and right sidewalls without appreciably affecting the cushioning ability of the midsole material between the left and right support walls of the stabilizer.

While the present invention has been described with reference to a specific embodiment, it should be understood that modifications and variations of the invention may be constructed without departing from the scope of the invention defined in the following claims.

What is claimed is:

1. A shoe sole providing cushioning and enhanced lateral and medial stability to a foot supported on the shoe sole, the shoe sole comprising:

a cushioned sole member having a vertical thickness, a longitudinal length and a lateral width, the sole member having opposite left and right sidewalls extending along its length and the sole member being formed of a resilient material having a first hardness;

means for stabilizing the left side of the sole member, the left side stabilizing means being embedded within the sole member and extending along at least a portion of the longitudinal length and at least a portion of the vertical thickness of the sole member juxtaposed adjacent the left sidewall, the left side stabilizing means being formed of a resilient material having a second hardness, different than the first hardness of the sole member;

means for stabilizing the right side of the sole member, the right side stabilizing means being embedded within the sole member and extending along at least a portion of the longitudinal length and at least a portion of the vertical thickness of the sole member juxtaposed adjacent the right sidewall, the right side stabilizing means being formed of a resilient material having the second hardness;

a base connected to the left side stabilizing means and the right side stabilizing means, the base having a vertical thickness less than a vertical thickness of the left side stabilizing means and less than a vertical thickness of the right side stabilizing means, and the base having a lateral width spacing the left and right stabilizing means apart from each other and positioning the left and right stabilizing means adjacent the left and right sidewalls of the sole member, respectively; and means for containing a fluid are provided inside the sole member, the fluid containing means being positioned in a center portion of the sole member between the left and right side stabilizing means.

2. The shoe sole of claim 1, wherein:

the second hardness is greater than the first hardness, and the left and right stabilizing means increase resistance to compression of the sole member adjacent the left and right sidewalls, respectively, while not effecting compression resistance of the sole member at an area of the sole member between the left and right stabilizing means.

3. The shoe sole of claim 1, wherein:

the left and right side stabilizing means have longitudinal lengths substantially equal to each other, and have vertical thicknesses substantially equal to each other.

4. The shoe sole of claim 1, wherein:

the sole member has a forefoot section, an arch section and a heel section and the left and right stabilizing means are contained in the heel section.

5. The shoe sole of claim 1, wherein:

the sole member has a forefoot section, an arch section and a hell section and the left and right stabilizing means are contained in the arch section.

6. The shoe sole of claim 1, wherein:

the sole member has a forefoot section, an arch section and a heel section and the left and right stabilizing means are contained in the forefoot section.

7. The shoe sole of claim 1, wherein:

the left side stabilizing means and the right side stabilizing means are both transparent, enabling the fluid containing means to be viewed from outside the left and right sidewalls of the sole member through the left and right stabilizing means respectively.

8. The shoe sole of claim 1, wherein:

the left side stabilizing means is a left side support wall formed of a material having a hardness greater than the hardness of the sole member to increase compression resistance of the sole member adjacent the left sidewall, the left side support wall has a longitudinal length that extends along at least a portion of the longitudinal length of the sole member left sidewall and a vertical thickness that extends along at least a portion of the vertical thickness of the sole member left sidewall, the vertical thickness of the left side support wall being greater than the vertical thickness of the base;

the right side stabilizing means is a right side support wall formed of a material having a hardness greater than the hardness of the sole member to increase compression resistance of the sole member adjacent the right sidewall, the right side support wall has a longitudinal length that extends along at least a portion of the longitudinal length of the sole member right sidewall and a vertical thickness that extends along at least a portion of the vertical thickness of the sole member right sidewall, the vertical thickness of the right side support wall being greater than the vertical thickness of the base; and the base connects the left side support wall to the right side support wall with the base positioned therebetween, the lateral width of the base spacing the left and right side support walls laterally apart from each other and adjacent the left and right sidewalls of the sole member, respectively.

9. The shoe sole of claim 8, wherein:

a fluid filled pad is contained inside the sole member and is positioned adjacent the base and between the left and right side support walls.

10. The shoe sole of claim 9, wherein:

the left side support wall and the right side support wall are both transparent, enabling the fluid filled pad contained in the sole member to be viewed from outside the left and right sidewalls of the sole member through the left and right support walls, respectively.

11. A shoe sole providing cushioning and enhanced lateral and medial stability to a foot supported on the shoe sole, the shoe sole comprising:

a cushioned sole member having a vertical height, a longitudinal length and a lateral width, the sole member having opposite left and right sidewalls extending along its length and the sole member being formed of a resilient material having a first hardness;

means for stabilizing the left side of the sole member, the left side stabilizing means being embedded within the sole member and extending along at least a portion of the longitudinal length and at least a portion of the vertical height of the sole member juxtaposed adjacent the left sidewall, the left side stabilizing means being formed of a resilient material having a second hardness, different than the first hardness of the sole member;

means for stabilizing the right side of the sole member, the right side stabilizing means being embedded within the sole member and extending along at least a portion of the longitudinal length and at least a portion of the vertical height of the sole member juxtaposed adjacent the right sidewall, the right side stabilizing means being formed of a resilient material having the second hardness;

the left and right side stabilizing means are spaced laterally apart from each other and the left and right side stabilizing means have substantially equal longitudinal lengths and substantially equal vertical heights; and means for containing a fluid are provided inside the sole member, the fluid containing means being positioned in a center portion of the sole member between the left and right stabilizing means.

12. The shoe sole of claim 11, wherein:

the second hardness is greater than the first hardness, and the left and right side stabilizing means increase resistance to compression of the sole member adjacent the left and right sidewalls, respectively, while not effecting compression resistance of the sole member at an area of the sole member between the left and right stabilizing means.

13. The shoe sole of claim 11, wherein:

a base is connected to the left and right stabilizing means and extends laterally across the sole member between the left and right stabilizing means, the base has a vertical height less than the vertical height of the left and right stabilizing means and the base has a lateral width that spaces the left and right stabilizing means apart from each other and positions the left and right stabilizing means adjacent the left and right sidewalls of the sole member, respectively.

14. The shoe sole of claim 11, wherein:

the sole member has a forefoot section an arch section and a heel section and the left and right stabilizing means are contained in the heel section.

15. The shoe sole of claim 11, wherein:

the sole member has a forefoot section, an arch section and a heel section and the left and rights stabilizing means are contained in the arch section.

16. The shoe sole of claim 11, wherein:

the sole member has a forefoot section, an arch section and a heel section and the left and right stabilizing means are contained in the forefoot section.

17. The shoe sole of claim 11, wherein:

the left side stabilizing means and the right side stabilizing means are both transparent, enabling the fluid containing means to be viewed from outside the left and right sidewalls of the sole member through the left and right stabilizing means respectively.

18. The shoe sole of claim 11, wherein:

the left side stabilizing means is a left side support wall formed of a material having a hardness greater than the hardness of the sole member to increase compression resistance of the sole member adjacent the left sidewall, the left side support wall has a longitudinal length that extends along at least a portion of the longitudinal length of the sole member left sidewall and a vertical height that extends along at least a portion of the vertical height of the sole member left sidewall;

the right side stabilizing means is a right side support wall formed of a material having a hardness greater than the hardness of the sole member to increase compression resistance of the sole member adjacent the right sidewall, the right side support wall has a longitudinal length that extends along at least a portion of the longitudinal length of the sole member right sidewall and a vertical height that extends along at least a portion of the vertical height of the sole member right sidewall; and the longitudinal length and vertical height of the left side support wall and the right side support wall are substantially equal.

19. The shoe sole of claim 18, wherein:

a fluid filled pad is contained inside the sole member and is positioned between the left and right side support walls.

20. The shoe of claim 19, wherein:

the left side support wall and the right side support wall are both transparent, enabling the fluid filled pad contained in the sole member to be viewed from outside the left and right sidewalls of the sole member through the left and right side support walls, respectively.

21. A shoe sole providing cushioning and enhanced lateral and medial stability to a foot supported on the shoe sole, the shoe sole comprising:

a cushioned sole member having a vertical height, a longitudinal length and a lateral width, the sole member having opposite left and right sidewalls extending along its length and the sole member being formed of a resilient material having a first hardness;

a stabilizing means embedded within the sole member, the stabilizing means including a left side support wall formed of a material having hardness greater than the hardness of the sole member, the left side support wall having a longitudinal length that extends along at least a portion of the longitudinal length of the sole member left sidewall and a vertical height that extends along at least a portion of the vertical height of the sole member left sidewall;

the stabilizing means including a right side support wall formed of a material having a hardness greater than the hardness of the sole member, the right side support wall having a longitudinal length that extends along at least a portion of the longitudinal length of the sole member right sidewall and a vertical height that extends along at least a portion of the vertical height of the sole member right sidewall;

the stabilizing means including a base connecting the left side support wall to the right side support wall with the base positioned therebetween, the base having a vertical height less than the vertical height of the left and right side support walls and the base having a lateral width that spaces the left and right side support walls laterally apart from each other and positions the left and right side support walls juxtaposed adjacent the left and right sidewalls of the sole member, respectively, whereby the left and right side support walls increase compression resistance of the sole member adjacent the left sidewall and right sidewall respectively; and a fluid filled pad is contained inside the sole member and is positioned adjacent the base and between the left and right side support walls, and the stabilizing means is transparent enabling the fluid filled pad contained in the sole member to be viewed from outside the sole member through the stabilizing means.

* * * * *